US007188386B2

(12) United States Patent
Kohlruss et al.

(10) Patent No.: US 7,188,386 B2
(45) Date of Patent: Mar. 13, 2007

(54) MANUAL CLEANING DEVICE

(76) Inventors: Gregor Kohlruss, Pater-Eugen-Breitensteinstr. 1, 46325 Borken (DE); Hubert Wiesner, Grüner Weg 21, 46354 Südlohn (DE); Oliver Griebe, Heideweg 12, 46414 Rhede (DE)

( * ) Notice: Subject to any disclaimer, the term of this patent is extended or adjusted under 35 U.S.C. 154(b) by 0 days.

(21) Appl. No.: 10/482,620

(22) PCT Filed: May 18, 2002

(86) PCT No.: PCT/EP02/05529

§ 371 (c)(1),
(2), (4) Date: May 28, 2004

(87) PCT Pub. No.: WO03/001956

PCT Pub. Date: Jan. 9, 2003

(65) Prior Publication Data

US 2004/0194244 A1 Oct. 7, 2004

(30) Foreign Application Priority Data

Jun. 27, 2001 (DE) ..... 201 10 502 U

(51) Int. Cl.
*A47L 1/15* (2006.01)
*A47L 13/16* (2006.01)
*A47L 13/46* (2006.01)

(52) U.S. Cl. ..... 15/209.1; 15/210.1; 15/220.1

(58) Field of Classification Search ..... 15/209.1, 15/210.1, 229.13, 220.1
See application file for complete search history.

(56) References Cited

U.S. PATENT DOCUMENTS

| | | | | |
|---|---|---|---|---|
| 2,011,214 | A | 8/1935 | Erickson | |
| 2,484,986 | A * | 10/1949 | Ellinger | 15/229.13 |
| 2,516,396 | A | 7/1950 | Kersh | |
| 2,560,008 | A * | 7/1951 | Steward | 15/231 |
| 3,229,317 | A * | 1/1966 | Linenfelser | 15/121 |
| 3,369,267 | A * | 2/1968 | Friedland et al. | 15/104.94 |
| 3,981,040 | A * | 9/1976 | Crofton | 15/229.2 |
| 6,718,590 | B1 * | 4/2004 | Jimison | 15/210.1 |

FOREIGN PATENT DOCUMENTS

DE 3824369 4/1989

* cited by examiner

*Primary Examiner*—Randall Chin
(74) *Attorney, Agent, or Firm*—Collard & Roe, P.C.

(57) ABSTRACT

A manual cleaning device has a support and a cover therefor. The device improves upon currently used manual cleaning devices in such a way that it is more suitable for removing dirt from places which are difficult to access, such as edges or joints, and it can provide a high specific surface pressure when required in order to remove solidly adhering dirt. The support is embodied as a bending, elastic flat blade which is surrounded by a cover. The support has a grip element which is used to fix the support to the cover.

5 Claims, 1 Drawing Sheet

Fig. 1
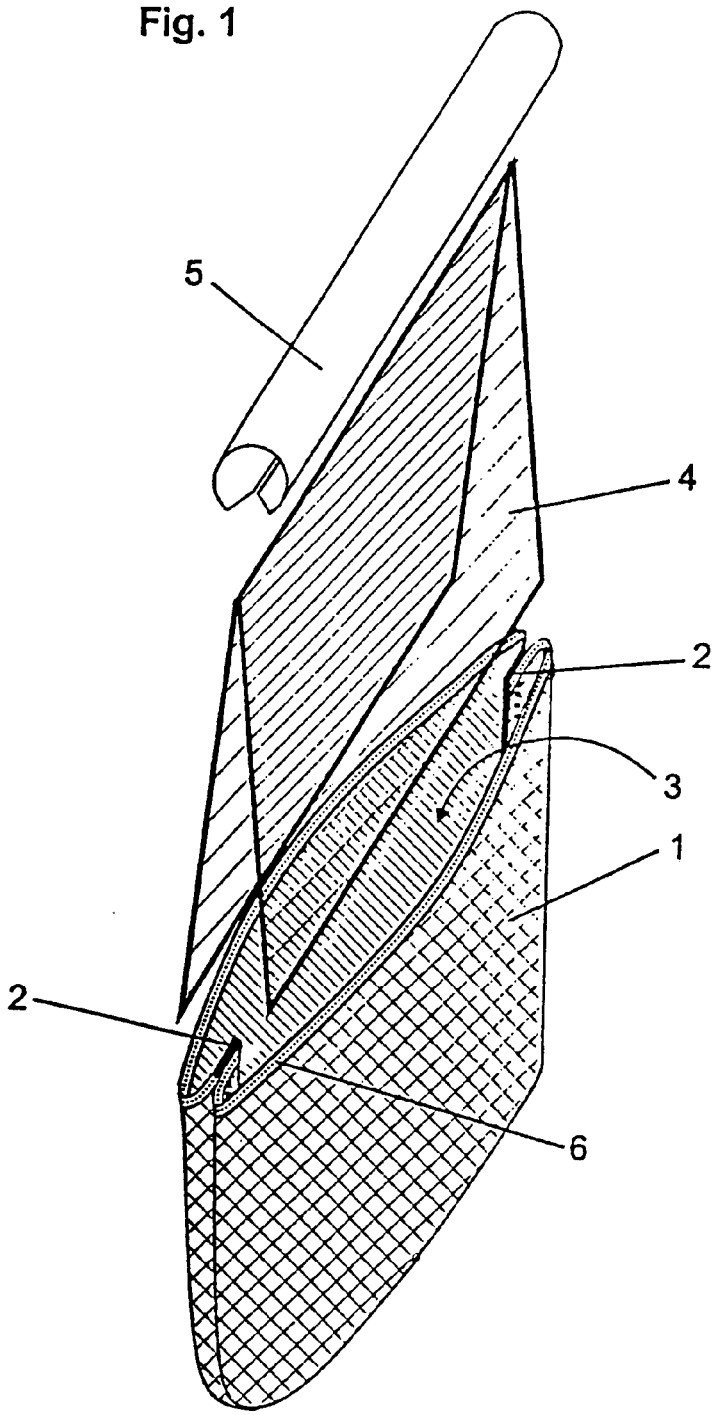
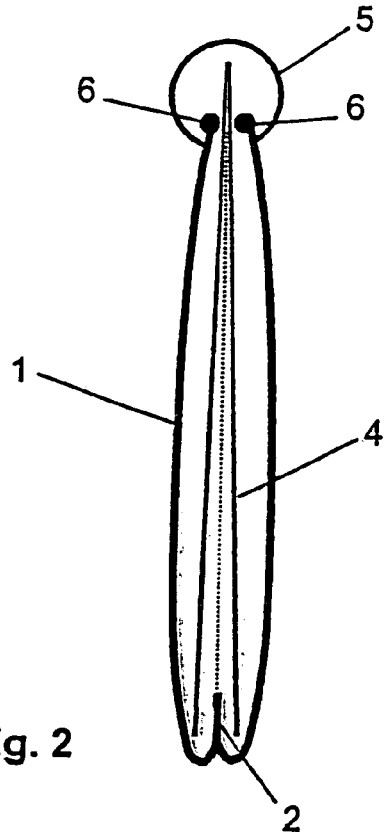
Fig. 2

MANUAL CLEANING DEVICE

Applicants claim priority under 35 U.S.C. §119 of German Application No. 201 10 502.0 filed on Jun. 27, 2001. Applicants also claim priority under 35 U.S.C. §365 of PCT/EP02/05529 filed on MAY 18, 2002. The international application under PCT article 21 (2) was not published in English.

BACKGROUND OF THE INVENTION

1. Field of the Invention

The invention relates to a manual cleaning device having a support and a cover applied to it.

2. The Prior Art

Such manual cleaning devices, which particularly serve for cleaning smooth surfaces, such as panes of glass, for example, are generally known. They generally consist of a core element that is configured as a sponge, and serves as a support for the cover applied to it. In this connection, the cover consists of leather or of textile. In the previously known cleaning devices, the core element is normally absorbent, so that cleaning liquid can be absorbed and stored. Furthermore, embodiments are known in which the cover is replaceable and can be fixed in place on the support in different ways.

The main disadvantage of the previously known manual cleaning devices is that because of the use of an easily deformable sponge as the support, it is not possible to exert sufficient pressure on the surface to be cleaned. Particularly in the case of stubbornly adhering dirt, there is the need to press the cleaning textile of the cover against the surface to be cleaned, with great force, so that a sufficient cleaning effect can be achieved. If a cleaning device of the type previously known is pressed against the surface with greater force, it is disadvantageous that the core element deforms to such a degree that the cover lies against the object to be cleaned with the entire cleaning surface that is available. It is therefore not possible to achieve the high contact pressure that is necessary for removing stubborn dirt.

It is furthermore disadvantageous that the previously known manual cleaning devices are not suitable for reliably removing dirt from places that are difficult to access, such as edges or joins, for example. Because of the easily deformable core element, the cleaning textile is again prevented from getting into edges or small joins with a sufficient cleaning effect.

SUMMARY OF THE INVENTION

Proceeding from this, the present invention is based on the task of making available a manual cleaning device that avoids the aforementioned problems and that furthermore is easy to handle and can be produced at low cost.

This task is accomplished, proceeding from a manual cleaning device of the type stated initially, in that the support is configured as a bending, elastic flat blade, which is surrounded by the cover.

By means of the use of the bending, elastic flat blade, the deformability of the support is greatly restricted as compared with the previously known manual cleaning devices. By means of targeted bending of the blade, the user can control the cleaning surface of the cover that rests on the surface to be cleaned, in targeted manner. A particularly high pressure can be exerted to remove stubborn dirt if the cover is merely pressed onto the surface to be cleaned with its narrow edge, in the region of the front edge of the support.

It is advantageous that the possibility exists of adapting the bending rigidity of the support blade to the desired purpose of use, in that the material thickness of the blade is predetermined in suitable manner, for example. Various commercially available plastics can be used as the support in the case of the manual cleaning device according to the invention.

The cleaning device according to the invention is particularly suitable for removing dirt from places that are difficult to access. The manual cleaning device can be guided by the user in such a manner that the narrow cleaning surface in the region of the front or bottom edge of the support blade gets into edges or also into narrow gaps. Because of the rigidity of the bending, elastic blade, sufficient forces for removing stubbornly adhering dirt can be exerted in this connection.

It is advantageous if the cover of the manual cleaning device according to the invention has an insertion opening for the support on one side. This creates the possibility of replacing the cover at any time. The cover forms a pocket into which the support blade can be inserted.

To handle the manual cleaning device according to the invention, the support can have a grip element, whereby it is particularly advantageous if the support can be fixed in place on the cover in the region of the insertion opening, by means of the grip element. A particularly simple and practical embodiment results, in this connection, if the grip element is configured as a clamp tube slit lengthwise, which holds the cover in place on the support, in that the cover and the support, one on top of the other, are clamped into the slit of the clamp tube. In this manner, the cover and the support blade are fixed in place on one another by a force fit, and all that is needed to replace the cover is to pull the clamp tube off in the axial direction, after which the support blade is no longer connected with the cover. The cover can be fixed in place on the support in particularly secure manner if the clamp tube additionally surrounds a hem made on the cover in the region of the insertion opening, with a positive lock. The positive lock guarantees that the cover cannot be pulled off the support unintentionally, even if greater forces are exerted on the cleaning device during cleaning work.

Alternatively, there is the possibility of providing fixation elements on the support, which engage in undercuts provided in the holder space of the cover, forming a positive lock, when the cover is pushed onto the support. These fixation elements can be, for example, resilient locking elements affixed to the support, which hold the cover that has been pulled onto the support in place, with a positive lock, in a position in which they are spread away from the support. To produce the positive lock, all that is necessary is to place suitable undercuts in the holder space of the cover, which interact with the locking elements. To replace the cover, the resilient locking elements are merely pressed together by hand, so that the positive lock with the undercuts of the cover is eliminated and the cover can be easily pulled off. It is further advantageous, in this connection, that the locking elements, in their locked position, hold the cover stretched out, in interaction with the support. It is important, particularly in connection with cleaning work, that the cover is held in its flat shape, thereby resulting in optimal utilization of the cleaning surface. The positive-lock fixation assures that the cover cannot slip off, even during vigorous cleaning movements.

An advantageous further development results, for the manual cleaning device according to the invention, if the support is configured as a double-layer blade, whereby the two layers are connected with one another at the edge of the blade that faces the insertion opening. Usually, the cover consists of two layers of a textile material that are sewn together. This results in a pocket for the support blade, which has hems at the edges at which the textile layers are sewn together, which hems project into the interior of the pocket. Because the support is configured as a double-layer blade, these hems can be clamped in between the two layers of the support, so that the cover is fixed in place on the outside edges of the support blade. In this way, the cover is securely fixed in place on the support, and cannot slip out of position even during heavy scrubbing.

A cleaning plush is particularly suitable as a textile material for the cover of the manual cleaning device according to the invention, since it is particularly absorbent and can store cleaning liquid.

BRIEF DESCRIPTION OF THE DRAWINGS

An exemplary embodiment of the invention will be explained in greater detail in the following, using the drawings. These show:

FIG. 1 perspective view of a manual cleaning device according to the invention;

FIG. 2 cross-sectional representation of the manual cleaning device according to FIG. 1.

DETAILED DESCRIPTION OF PREFERRED EMBODIMENTS

The drawings show a cover 1, which consists of two layers of a cleaning textile that are sewn together. The cover 1 shown has a rectangular shape and has a seam at each of three edges, which form a hem 2 that projects into the holder space of the cover 1. The cover 1 shown forms a pocket with an upper insertion opening 3 for a bending, elastic support 4 that is configured as a flat blade. The support blade 4 is configured in two layers, whereby the two layers are connected with one another at the top edge of the blade. Because of this V-shaped configuration of the support blade 4, the hems 2 that project into the interior of the cover 1 can be clamped in between the two layers of the support blade 4, not only at the side edges but also at the bottom edge. The manual cleaning device shown in FIGS. 1 and 2 has a grip element 5 with which the support 4 can be fixed in place on the cover 1 in the region of the insertion opening 3. For this purpose, the grip element 5 is configured as a clamp tube that is slit lengthwise, which holds the cover 1 in place on the support 4, whereby the cover 1 and the support 4, which lie on top of one another, are clamped in the slit of the clamp tube 5. To fix the cover 1 in place with respect to the support 4, hems 6 are furthermore made on the cover 1 in the region of the insertion opening 3, which are surrounded by the clamp tube 5, forming a positive lock.

The invention claimed is:

1. A manual cleaning device comprising:

(a) a support comprising a bending, elastic flat blade;

(b) a pocket-shaped cover surrounding said blade, said cover comprising a first side having a top insertion opening for the support and a bottommost edge facing away from the insertion opening; and (c) a grip element for securing the support with respect to the cover near the top insertion opening, said grip element being configured as a clamp tube slit lengthwise, which holds the cover in place with respect to the support, so that the cover and the support, one on top of the other, are clamped into the slit of the clamp tube;

wherein said support extends from the grip element to the bottommost edge, and wherein the clamors tube additionally surrounds a hem made on the cover in the region of the insertion opening, with a positive lock.

2. The manual cleaning device according to claim 1, wherein the support is configured as a double-layer blade, whereby the two layers are connected with one another at a top edge of the blade, which faces the insertion opening.

3. The manual cleaning device according to claim 1, wherein the cover comprises textile material.

4. The manual cleaning device according to claim 3, wherein the textile material is a cleaning plush.

5. A manual cleaning device comprising:

(a) a support comprising a bending, elastic flat blade;

(b) a pocket-shaped cover surrounding said blade, said cover comprising a first side having a too insertion opening for the support and a bottommost edge facing away from the insertion opening; and (c) a grip element for securing the support with respect to the cover near the top insertion opening, wherein said support extends from the grip element to the bottommost edge and wherein the cover comprises a holder space and a plurality of undercuts provided in the holder space, and the support comprises a plurality of fixation elements that engage in the undercuts to form a positive lock when the cover is pushed onto the support.

* * * * *